United States Patent [19]

Fetko et al.

[11] Patent Number: 4,639,102

[45] Date of Patent: Jan. 27, 1987

[54] FOLDING DOUBLE MIRROR DEVICE

[76] Inventors: Paul Fetko, 6200 Rivercliffe Dr., NW., Atlanta, Ga. 30328; Lawrence C. Zaglin, 3830 Paces Ferry West, NW., Atlanta, Ga. 30339

[21] Appl. No.: 700,177

[22] Filed: Feb. 11, 1985

[51] Int. Cl.[4] ..... A45D 42/18; A45D 42/00

[52] U.S. Cl. ..... 350/626; 350/616; D28/64.1

[58] Field of Search ..... 350/600, 611, 612, 626, 350/631; 248/472–474, 475.1; 132/79 G, 80 A, 83 A, 83 C, 83 E; D28/64.1, 64.3, 64.4, 64.7

[56] References Cited

U.S. PATENT DOCUMENTS

| | | | |
|---|---|---|---|
| 881,947 | 3/1908 | Petersen | 350/616 X |
| 1,512,005 | 10/1924 | Wright | 132/83 E |
| 1,815,966 | 7/1931 | Campbell | 350/616 |
| 3,527,527 | 9/1970 | Manowitz | 132/83 E X |

FOREIGN PATENT DOCUMENTS

| | | | |
|---|---|---|---|
| 1068869 | 5/1953 | Fed. Rep. of Germany | 350/616 |

*Primary Examiner*—Donald Watkins

*Attorney, Agent, or Firm*—Harvey B. Jacobson

[57] ABSTRACT

A pair of shallow open-sided housing halves are provided and pivotally joined along corresponding marginal portions for swinging of the housing halves between closed positions with the open sides of the housing opening into each other and open positions with the open sides of the housing defining an included angle of generally 90°. The housing halves each have a plain mirror element mounted therein in recessed position within the corresponding housing half and structure is provided by which the housing halves may be releasably retained in positions with the reflective surfaces of the mirror elements defining an included angle of substantially 75°. In addition, the last-mentioned structure also is operable to releasably retain the housing halves in open positions with the reflective surfaces of the mirror elements defining an included angle of 90°.

7 Claims, 3 Drawing Figures

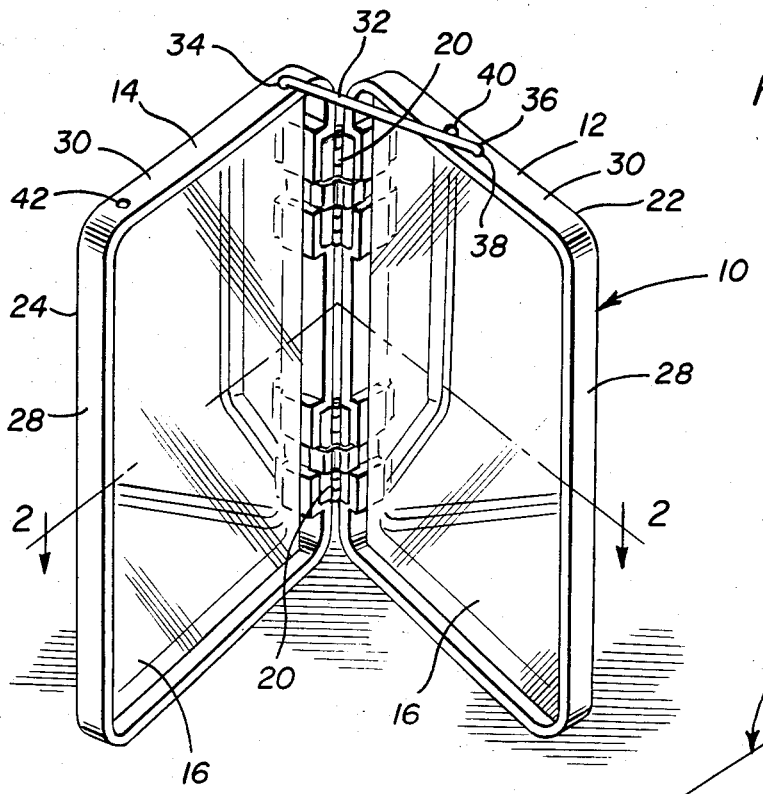
FIG. 1
FIG. 3
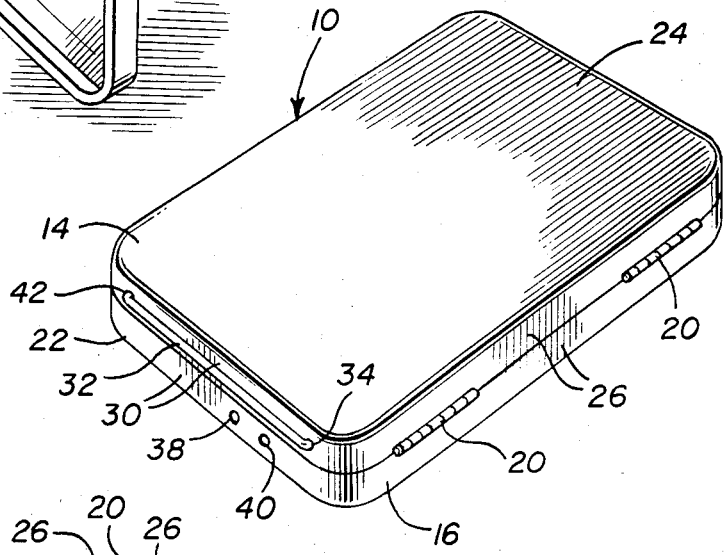
FIG. 2
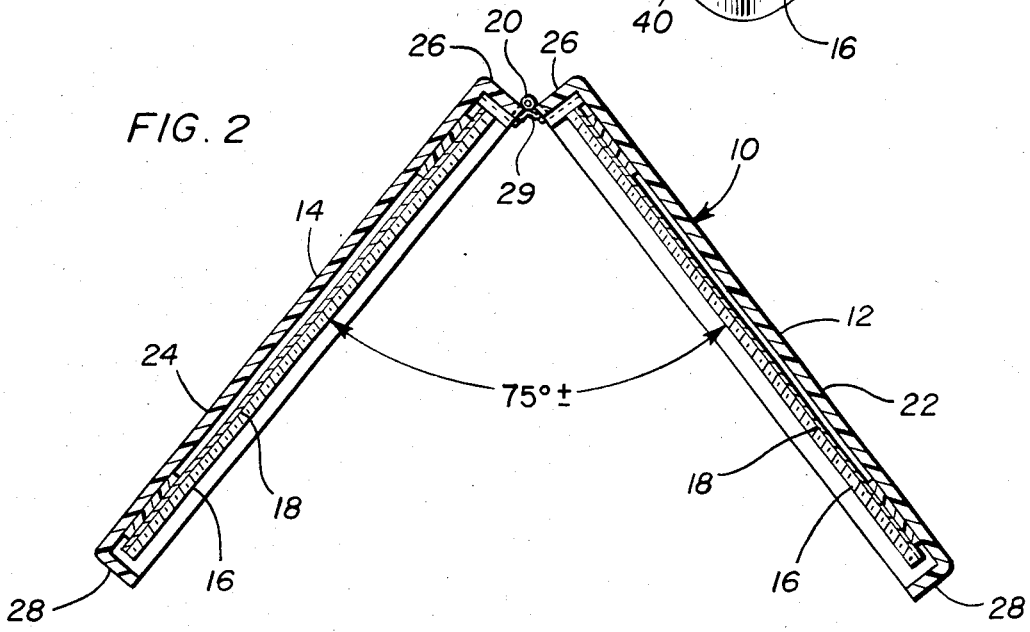

FOLDING DOUBLE MIRROR DEVICE

BACKGROUND OF THE INVENTION

When a person views himself or herself in a mirror, the image afforded is reversed in front-to-rear relation in a manner such that the right and left sides of the face of the viewer appear as the left and right sides of the face. This reversal of image usually does not cause any problem to the viewer, inasmuch as the viewer has grown up and become accustomed to the reversal of the image obtained by user when viewing himself or herself in a mirror.

However, when the viewer is attempting to apply makeup it is impossible for the user to view himself or herself as seen by others. Accordingly, a need exists for a mirror construction whereby the user of the mirror may view himself or herself as seen by others.

FIELD OF THE INVENTION

This invention relates to a mirror assembly incorporating a pair of mirror members hinged together along adjacent sides for relative swinging between closed positions with the mirror members disposed in closely juxtaposed positions and open positions wherein the mirror members defined an included angle of at least 90° and whereby the mirror members may be removably anchored in positions wherein they define an included angle of substantially 75°.

DESCRIPTION OF RELATED ART

Various different forms of hinged mirror assemblies such as those disclosed in U.S. Pat. Nos. 370,623, 1,377,161, 1,434,167, 1,552,166, 2,109,586, 3,022,709 and 4,050,790 heretofore have been provided. However, these previously known forms of mirror assemblies are not constructed in a manner whereby a pair of mirror members hingedly connected relative to each other may be removably anchored in positions with the reflective surfaces of the mirror members defining an included angle of substantially 75°.

SUMMARY OF THE INVENTION

The mirror device of the instant invention includes a pair of mirror members pivotally joined together along adjacent marginal edge portions for relative swinging of the mirror members between closed and open positions. The mirror members include reflective surfaces disposed in closely juxtaposed position when the mirror members are in the closed positions and the mirror assembly includes structure whereby the mirror members may be swung to and releasably retained in positions with the reflective surfaces thereof defining an included angle of substantially 75°.

The main object of this invention is to provide a mirror assembly specifically designed to enable the user of the mirror assembly to view himself or herself as others view the user.

Another object of this invention is to provide a mirror assembly whose reflective surfaces may also be pivoted to positions defining an included angle of substantially 90° thereby enabling use of the mirror assembly in the same manner in which other 90° angularly displaced adjacent reflective surfaces may be used.

Still another important object of this invention is to provide a mirror assembly including structure by which the reflective surfaces thereof may be protected against damage when the relatively angularly displaceable mirror members thereof are in the closed juxtaposed positions.

A final object of this invention to be specifically enumerated herein is to provide a mirror assembly in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING

FIG. 1 is a perspective view of the mirror assembly of the instant invention with the mirror members thereof disposed in open positions with the reflective surfaces of the mirror members defining an included angle of substantially 75°;

FIG. 2 is an enlarged horizontal sectional view taken substantially upon the plane indicated by the section line 2—2 of FIG. 1; and FIG. 3 is a perspective view of the mirror assembly in the closed position.

DESCRIPTION OF THE PREFERRED EMBODIMENT

Referring now more specifically to the drawings, the numeral 10 generally designates the mirror assembly of the instant invention. The assembly 10 includes a pair of mirror members 12 and 14 each supporting a plain mirror elements 16 therefrom equipped with a reflective surface 18. A pair of hinge assemblies 20 pivotally interconnect the mirror members 12 and 14 for relatived swinging between the closed positions thereof illustrated in FIG. 3 and open positions such as those illustrated in FIG. 1 wherein the mirror members 12 are disposed with the reflective surfaces 18 thereof defining an included angle of substantially 75°. However, the hinge assemblies 20 allow the mirror members 12 and 14 to be swung to at least slightly more open positions with the reflective surfaces 18 defining an included angle of at least 90°.

The mirror members 12 and 14 include open-sided housings 22 and 24 each defining first and second opposite marginal portions 28 and third marginal portions 30 extending between and connecting one corresponding pair of ends of the marginal portions 26 and 28.

The hinge assemblies 20 each includes an associated leaf spring 29 which serves not only to yieldingly retain the mirror assemblies 12 and 14 in open positions wherein the reflective surfaces 18 define an included angle of 90°, but which also serve to yieldingly retain the mirror members 12 and 14 in the closed positions. Although the hinge assemblies 20 function to limit swinging movement of the mirror members 12 and 14 toward open positions with the reflective surfaces 18 defining an included angle of substantially 90°, it is to be noted that different hinge assemblies 20 may be utilized which enable the mirror members 12 and 14 to swing toward open positions in which the reflective surfaces 18 define an included angle of substantially 180°.

One end of an elongated brace 32 is pivotally anchored, in a removable manner, to the third marginal portion 30 of the mirror member 14 as at 34 and the opposite end of the brace includes a downturned end 36 which may be removably anchored in an aperture 38 provided therefor in the third marginal portion 30 of the mirror member 12. When the brace 32 is thus secured between the mirror members 12 and 14 the reflective surfaces 18 define an included angle of substantially 75°. In addition, the third marginal portion 30 of the mirror member 12 also includes a second aperture 40 in which the downturned end 38 of the brace 32 may be removably anchored and when the brace 32 is used in this manner the reflective surfaces 18 define an included angle of substantially 90°.

It may also be noted from FIG. 1 of the drawings that the third marginal portion 30 of the mirror member 14 includes an aperture 42 which is similar to the apertures 38 and 40 and in which the downturned end 36 of the brace 32 may be secured to stationarily support the brace 32 when the mirror members 14 are in the closed positions thereof illustrated in FIG. 3.

The interior depth of the housings 22 and 24 is greater than that which is required to receive the mirror elements 16 therein. Accordingly, the mirror elements 16 are recessed within the housings 22 and 24 inwardly of the open sides thereof. Thus, relatively thin items may be stored between the housings 22 and 24 and the mirror elements 16 when the housings 22 and 24 are in the closed positions thereof illustrated in FIG. 3. In addition, the necessary structure of the mirror assembly 10 to provide the desired operational features thereof may be accomplished independent of the housings 22 and 24. In such case, merely the mirror elements 16 may be pivotally joined together along adjacent corresponding marginal edge portions by hinge assemblies similar to the hinge asssemblies 20.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A folding double mirror assembly including a pair of side-by-side mirror members each having a substantially reflective surface, mounting means pivotally connecting adjacent first marginal portions of said members together for relative swinging of said members between open positions with said reflective surfaces defining an included angle of at least 90° and closed positions with said surfaces disposed in substantially parallel juxtaposed relation, said mounting means including positioning means operative to releasably retentatively retain said mirror members in relatively angularly displaced positions with said reflective surfaces defining an included angle of substantially 75°.

2. The mirror assembly of claim 1 wherein said positioning means also includes means operative to releasably retentatively retain said mirror members in relatively angularly displaced positions with said reflective surfaces defining an included angle of substantially 90°.

3. The mirror assembly of claim 1 wherein said mirror members each define a shallow open-sided housing and said reflective surfaces are defined by mirror elements mounted within said housing with the reflective sides of said elements facing outwardly of said open sides, said open sides being closely juxtaposed and opening into each other when said mirror members are in said closed positions.

4. The mirror assembly of claim 3 wherein said mirror elements are mounted within said housing in positions recessed inwardly of the open sides thereof.

5. The mirror assembly of claim 1 wherein said mirror members include second marginal portions opposite said adjacent said first marginal portions and which swing toward and away from each other as said mirror members are swung between said open and closed positions, each mirror member also including a pair of corresponding third marginal portions extending between corresponding first and second marginal portion ends and which are disposed in closely juxtaposed positions when said mirror members are in the closed positions thereof, said positioning means including an elongated brace having a first end pivotally anchored to the outer side of one of said third marginal portions at a location spaced intermediate the corresponding first and second marginal portions and coacting means on the other end of said brace and the other third marginal portion operative to releasably anchor said other end to the outer side of said other third marginal portion at a point in which said reflective surfaces define an included angle of substantially 75°.

6. The mirror assembly of claim 5 wherein said coacting means also includes means for releasably anchoring said other end to the outer side of said other third marginal portion at a point with said reflective surfaces defining an included angle of substantially 90°.

7. The mirror assembly of claim 6 wherein the other end of said brace and the outer side of said one of said third marginal portions also include coacting means operative to releasably anchor said other end to said one third marginal portion with said brace substantially paralleling said one third marginal portion.

* * * * *